United States Patent [19]

Quiroz

[11] 4,211,420

[45] Jul. 8, 1980

[54] CHESS-LIKE BOARD GAME

[76] Inventor: Luis E. Quiroz, 901 W. Cavalcade, Houston, Tex. 77009

[21] Appl. No.: 935,127

[22] Filed: Aug. 21, 1978

[51] Int. Cl.[2] ..... A63F 3/02

[52] U.S. Cl. ..... 273/260; 273/290

[58] Field of Search ..... 273/260, 261, 262, 290, 273/255, 258

[56] References Cited

U.S. PATENT DOCUMENTS

| | | | |
|---|---|---|---|
| 972,382 | 10/1910 | Johnson-Jervis | 273/255 |
| 2,464,819 | 10/1945 | Leiberman | 273/262 |
| 3,113,777 | 12/1963 | Senick | 273/265 |
| 4,019,746 | 4/1977 | Hare | 273/290 |

FOREIGN PATENT DOCUMENTS

| | | | |
|---|---|---|---|
| 460288 | 11/1913 | France | 273/262 |
| 109737 | 1/1917 | United Kingdom | 273/260 |

*Primary Examiner*—Richard C. Pinkham
*Assistant Examiner*—R. Carl Moy
*Attorney, Agent, or Firm*—Neal J. Mosely

[57] ABSTRACT

A chess-like board game for use by two players comprises a checker board having a peripheral checker playing area with rows and columns of bilaterally alternating colored spaces. A central playing area comprising a checker area with rows and columns of bilaterally alternating colored spaces of a different color (i.e. blue) indicating the sea. The checkered areas are aligned both in rows and columns for movement of pieces along the outer peripheral area or through the central area. A set of chess-like pieces are provided on each side of the playing board including a plurality of different pieces having different moving characteristics. Each side of the board is provided with a marked area indicated as the target area for occupation by pieces of the opposing side. The central playing area (i.e. the sea) is provided with pieces functioning as boats for movement of the playing pieces across the sea. The boats may move only when occupied and then according to the characteristics of the piece occupying the boat. One boat is provided which is large enough to contain three different pieces and moves according to the characteristics any or all of the pieces occupying said boat.

8 Claims, 10 Drawing Figures

CHESS-LIKE BOARD GAME

BACKGROUND OF THE INVENTION

1. FIELD OF THE INVENTION

This invention relates to new and useful improvements in board games and more particularly to chess-like games utilizing a checkered playing board.

2. BRIEF DESCRIPTION OF THE PRIOR ART

Games played on checkered boards are some of the oldest games known. Checkers is one game which has been known for centuries and operates according to well known rules utilizing disc-shaped playing pieces, the moves of which are well known.

Chess is likewise one of the Old World's oldest game played on a checkered board. The types of pieces are designed for movement and capture of opposing pieces simulating a simple war situation. The game of chess has remained relatively unchanged through the years, although variations have been proposed from time to time which have not been widely accepted. Examples of prior art chess-like games which have been modified from the classic game of chess include those illustrated in U.S. Pat. Nos. 3,466,044; 3,873,101; 1,877,154; and 1,056,526.

Other prior art checkered board games of interest include the following: MacLein U.S. Pat. No. 4,015,849 discloses a chess-like game including an additional set of horsemen-like figures representative of war, famine, death, plague, fire, and vanity. Bialek U.S. Pat. No 3,806,125 discloses a modified chess game utilizing chess pieces having a slab-like configuration, which pieces may be stacked and modified in movement characteristics. Hills U.S. Pat. No. 3,799,547 discloses a modified checkered game board of somewhat enlarged size and including a moveable piece with apertures for moving simultaneously several playing pieces. Nolte U.S. Pat. No. 3,610,626 discloses a chess-like game wherein the playing area may be enlarged by addition of different playing boards. Tebbs U.S. Pat. No. 3,048,404 discloses a game played on a checkered board with pieces simulating aircraft. Paschal U.S. Pat. No. 3,414,165 discloses a game played on a checkered board utilizing pieces simulating war ships and auxiliary equipment including planes and torpedos.

SUMMARY OF THE INVENTION

It is therefore one object of this invention to provide a chess-like game played on a checkered board which expands the scope of moves of the pieces and strategies utilized and thus provides a challenging and interesting game for all players.

Another object of this invention is to provide a chess-like game played on a checkered board having distinct playing areas and distinctly marked target areas and auxiliary pieces for moving certain of the main attacking pieces through a selected area on the board.

Other objects of the invention will become more apparent from time to time throughout the specification and claims as hereinafter related.

A chess-like board game for use by two player comprises a checker board having a peripheral checker playing area with rows and columns of bilaterally alternating colored spaces. A central playing area comprising a checker area with rows and columns of bilaterally alternating colored spaces of a different color (i.e. blue) indicating the sea. The checkered areas are aligned both in rows and columns for movement of pieces along the outer peripheral area or through the central area. A set of chess-like pieces are provided on each side of the playing board including a plurality of different pieces having different moving chracteristics. Each side of the board is provided with a marked area indicated as the target area for occupation by pieces of the opposing side. The central playing area (i.e. the sea) is provided with pieces functioning as boats for movement of the playing pieces across the sea. The boats may move only when occupied and then according to the characteristics of the piece occupying the boat. One boat is provided which is large enough to contain three different pieces and moves according to the characteristics any or all of the pieces occupying said boat.

DESCRIPTION OF THE PREFERRED EMBODIMENT

Figure 1:
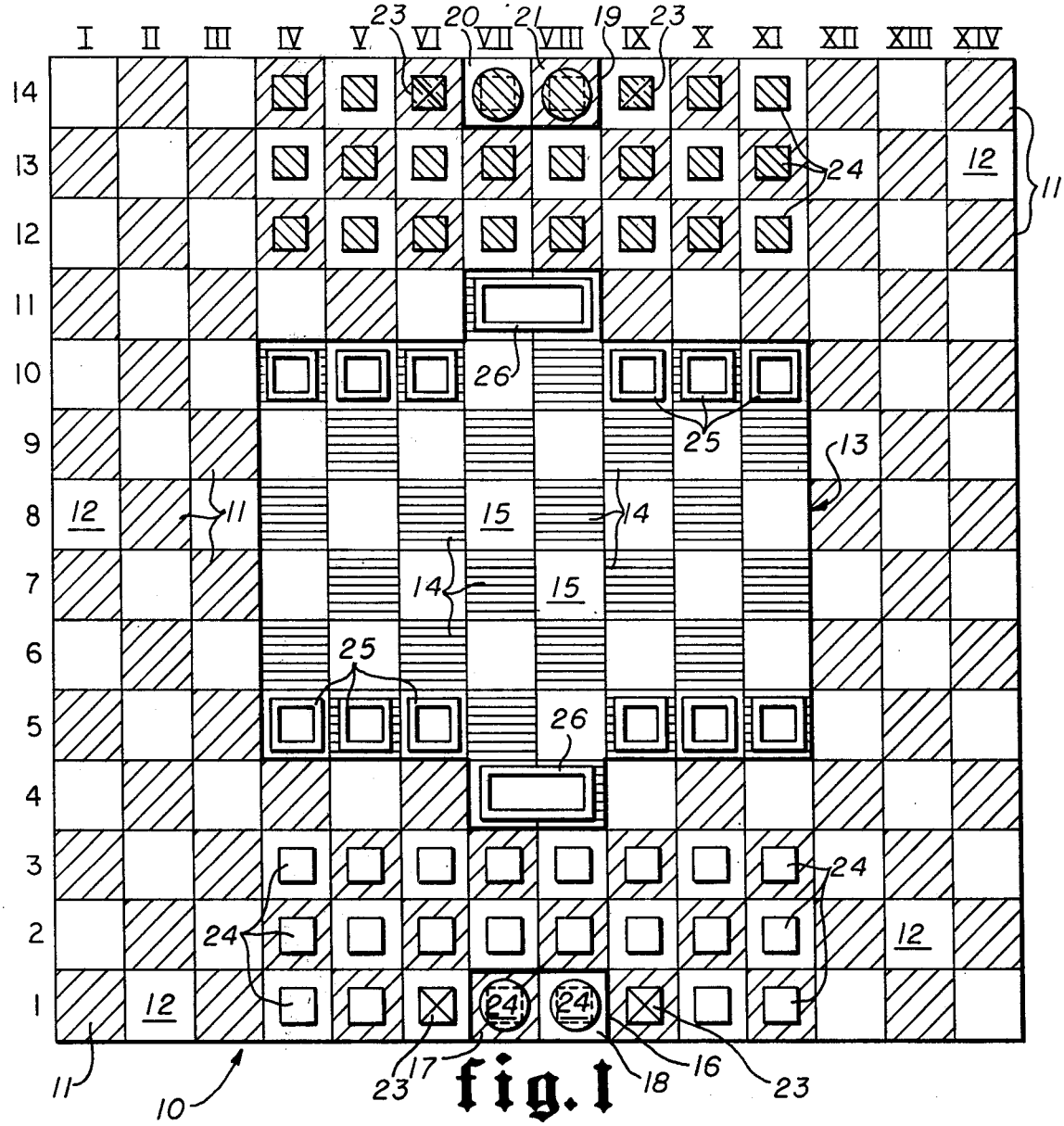
FIG. 1 is a plan view of a checkered board with playing pieces in position for play in accordance with this invention.

Referring to the drawings and, in particular, to FIG. 1, there is shown a checkered game board 10 consisting of alternating squares which are bilaterally colored, as indicated. The board has fourteen rows of squares and fourteen columns of squares, as indicated. In the drawing, the rows are numbered by Arabic numerals and the columns by Roman numerals. These numbers are used in the drawing strictly as coordinates for describing the movement of the playing pieces and would not ordinarily be on the playing board itself. The peripheral area of the board has the squares 11 colored black as indicated and alternating squares 12 colored white. At the center of the board is a discrete playing area marked by border 13 of a suitable distinguishing color. Within the border 13, the playing squares are of a different color. The colored squares are blue as indicated at 14 while the alternating squares 15 are white. On one side of the board a target area is provided which is marked by a boundary line 16 of distinctive color which surrounds playing squares 17 and 18, located at coordinates 1-VII and 1-VIII respectively. Likewise, on the other side of the board is a target area marked by boundary line 19 surrounding squares 20 and 21, located at coordinates 14-VII and 14-VIII, respectively.

A complete set of the playing pieces and their initial position on the playing board is shown in FIG. 1. The playing pieces consist of 20 of the basic pieces 22, which may be called checkers, soldiers, pawns, or the like. For convenience, this description we will use chess terminology and refer to the pieces 22 as pawns. There are provided two bishops 23 and two knights 24. An identical set of pieces arranged as shown is positioned on the opposite side of the board and differs only in color from the other set. The playing pieces will ordinarily be black and white as in a conventional chess set, although any other suitable contrasting colors could be used for the playing pieces of the opposing sides.

In the playing area surrounded by borderline 13, which is called the sea, there are provided a plurality of hollow pieces 25 which are small boats, located in row 5 and a single large boat 26, located in row 4. These boats are for transport of one or more of the playing pieces initially located in rows 1, 2 and 3, across the sea. Boats 25 will accepted only one of the playing pieces while boat 26 will accept up to three of the playing pieces of the same or different kind. A similar set of small boats of opposite color are initally positioned in row 10 and a single large boat of opposite color is initially positioned in row 11. The boats are not capable of independent movement but may be moved only when occupied by a playing piece of the same color. The large boat 26 likewise is not capable of independent movement but may be moved in accordance with the movement characteristics of any or all of the pieces of the small color occupying said boat. Initially, large boat 26 occupies the squares at coordinates 4-VII and 4-VIII. On the first move of large boat 26 it may move from either of the squares on which it sits, but subsequent moves are from a single square.

Figure 2:
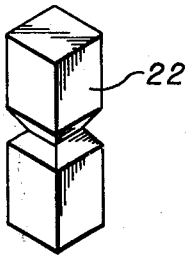
FIG. 2 is a detail view of one of the basic playing pieces (called a checker, pawn, soldier, or the like).
Figure 3:
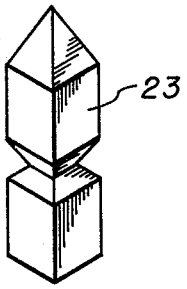
FIG. 3 is a detail view of one of the pieces called a bishop.
Figure 4:
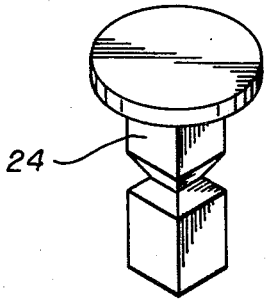
FIG. 4 is a detail view of one of the pieces called a knight.
Figure 5:
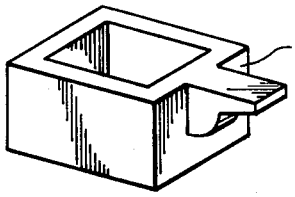
FIG. 5 is a detail view of a piece called a boat for moving one of the playing pieces across the water area of the board.
Figure 6:
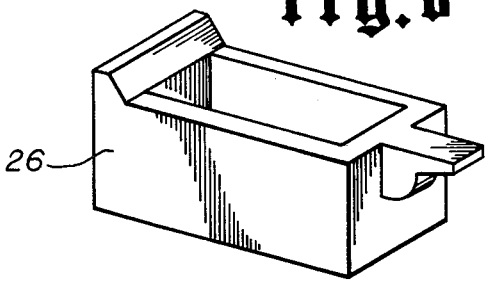
FIG. 6 is a detail view of an enlarged boat for carrying up to three of the playing pieces across the water area of the board.

In FIGS. 2 to 6 of the drawing, there are shown detail views of the playing pieces of the boats. One of the pawns 22 is shown in FIG. 2. One of the bishops 23 is shown in FIG. 3. One of the knights 24 is shown in FIG. 4. A small boat 25 is shown in FIG. 5. One of the large boats 26 is shown in FIG. 6. In these drawings, it is seen that the playing pieces are of square cross-section and fit into a square recess in small boat 25 for movement across the water area. The interior of large boat 26 is a rectangular recess which will accommodate up to three of the playing pieces.

Figure 7:
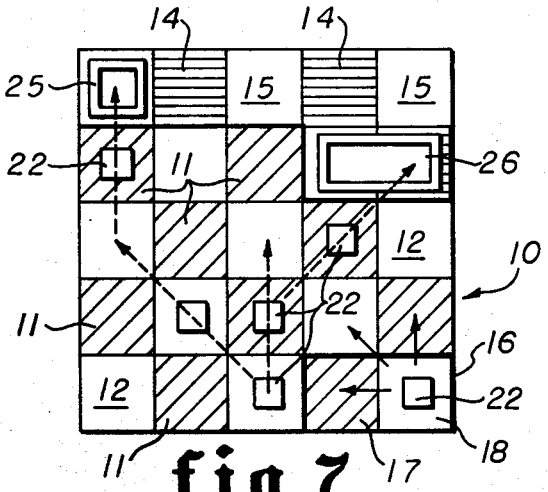
FIG. 7 is a detail plan view of a portion of the playing board illustrating the moves of the basic playing pieces (checker, pawn, soldier, or the like) on the board or into the boats.
Figure 8:
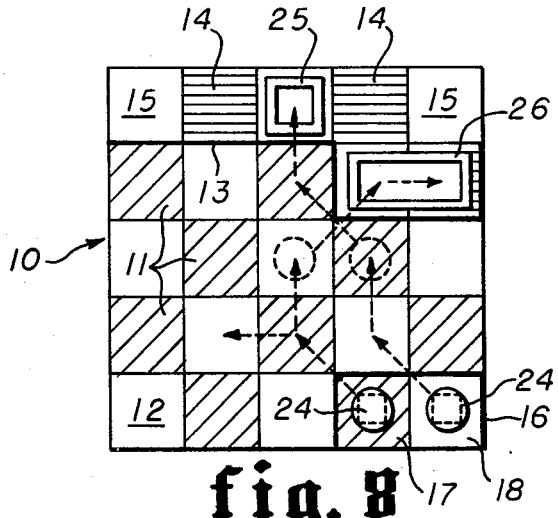
FIG. 8 is a detail plan view of a portion of the checkered board illustrating the moves of the knights, including moves into the boats.

Movement of the various pieces, including the boats, is illustrated in FIGS. 7 to 10. In FIG. 7, movement of the pawns 22 is illustrated. The pawns 22 may move forwardly or laterally in a straight line or forwardly on a diagonal line one square at a time. Thus, in FIG. 7, the pawn shown at square 1-VIII may move to any of squares 1-VII, 2-VII, 2-VIII, 2-IX and 1-IX. The pawn located at square 4-IV may cross the boundary line 13 and move into small boat 25, if desired, provided that boat 25 is unoccupied. In addition, pawns 22 may move forwardly or laterally in a straight line or diagonally in a straight line jumping over one of an adjacent piece (pawn, knight or bishop) of the same color to an unoccupied square beyond said piece. This movement may be continued as long as there are pieces to jump an unoccupied squares beyond the piece being jumped. These jumping moves may be made in a straight line direction along a row or column of squares or on the diagonal along squares of the same color. These jumping moves are also illustrated in FIG. 7. The pawn located at square 2-VI may jump over square 3-VII to enter the large boat at square 4-VIII. It should be noted that pieces may enter large boat 26 by entry of either of the squares 4-VII or 4-VIII. Pawn 22 on square 1-VI could jump to square 3-VI as indicated and could continue by jumping laterally to square 3-VIII. Pawn 22 at square 1-VI could likewise jump to square 3-IV and thence jump over square 4-IV to enter boat 25 on square 5-IV, provided that boat 25 is unoccupied. When one of the pawns 22 is occupying one of the boats 25, the boat containing the pawn may then move according to the rules for movement of the pawn on land, i.e. the black and white squares of the board, with the additional proviso that a boat 25 occupied by a pawn 22 may also move backward in a straight line or diagonally. This backward movement is forbidden to the pawns when moving on land, i.e. the black and white squares.

The movement of the knights 26 is in accordance with the movement of the knight of the game of chess. Thus, the knight 26 which is initially located on square 1-VIII may be moved initially to squares 2-VI, 3-VII, 2-X, or 3-IX. The movement of the knight 26 initially positioned on sqaure 1-VII could be to any of the squares 2-V, 3-VI, 3-VIII or 2-IX. The circles shown on squares 3-VI and 3-VII illustrate a first round move of the knights 26 to those positions. A second move of those knights would allow them to enter one or more of the boats. Thus, one of the knights 26 moved to square 3-VII could, on its second move, enter boat 25 on square 5-VI, as indicated. Likewise, a knight 26 moved on the first round to square 3-VI could, on the second move, enter the large boat 26 at square 4-VIII.

Figure 9:
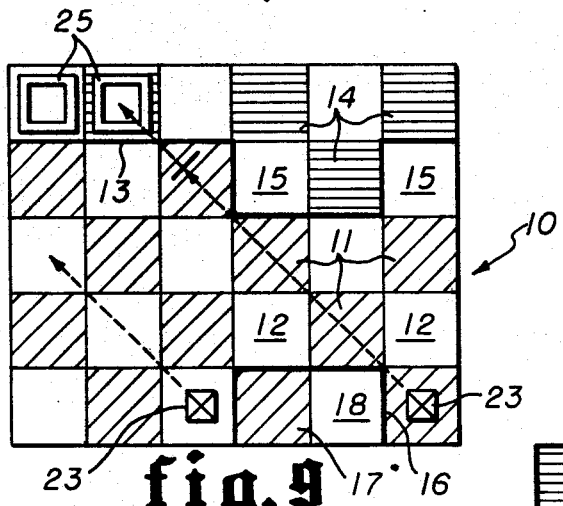
FIG. 9 is a detail plan view of a portion of the checkered board illustrating movement of the bishops, including movement into the boats.

The movement of the bishops 23 is in accordance with the move of the bishop at the game of chess, i.e., on the diagonal to an unobstructed destination. The bishop may not jump over any intervening piece in its move, whether such piece be of its own color or of the opposing color. The move of the bishop is illustrated in FIG. 9. A bishop located at the square 1-VI may move diagonally to square 3-IV or to square 4-IX. Likewise, the bishop located at 1-IX may move to square 4-VI. At this point the move of the bishop differs slightly from the game of chess. The bishop may move diagonally but must stop on the square adjacent the boundary line 13 surrounding the sea area (blue and white squares) of the board before entering an empty boat 25. In the move illustrated, the bishop 23 would move to square 4-VI on the initial move and on a subsequent move could enter an empty boat 25 located on square 5-V.

Figure 10:
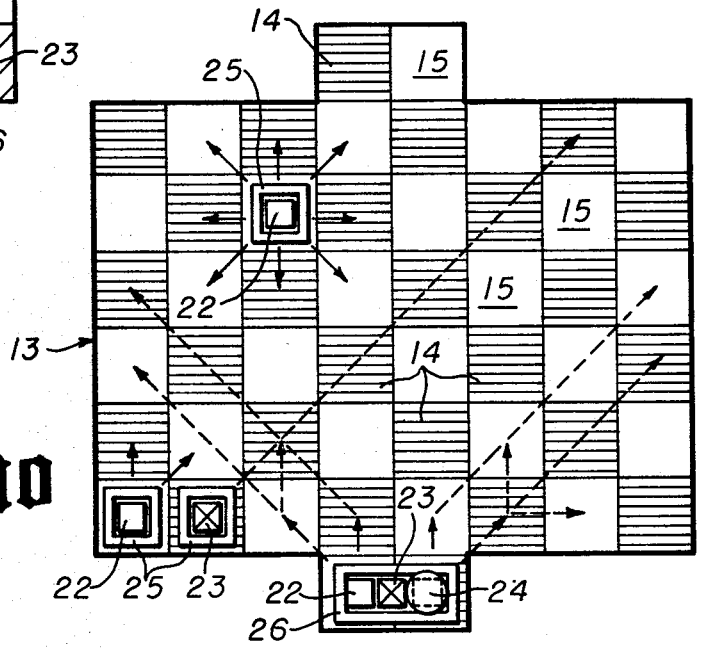
FIG. 10 is a detail view of the portion of the checkered board which is the sea and illustrating the movement of the boats in accordance with the pieces occupying said boats.

In FIG. 10, the movement of the small boats 25 and the large boat 26 is illustrated. In the position shown, small boat 25, containing pawn 22, is located on square 5-IV and may make a first round move to square 6-IV or 6-V, or may jump over the boat containing bishop 23 on square 5-V to empty square 5-VI. This latter move would not be permissible if boat 25 on square 5-V were unoccupied. On square 9-VI there is shown a boat 25 containing a pawn 26, for purposes of illustrating movement toward the central portion of the sea (blue and white) area. The boat, containing a pawn, may move one square in any straight line or diagonal direction, forward or backward, as shown by the arrows. The boat and pawn could therefore move to any of squares 10-V, 10-VI, 10-VII, 9-V, 9-VII, 8-V, 8-VI or 8-VII, provided that those squares are unoccupied. The boat 25 containing pawn 22 may also move by jumping over a boat which is occupied by a playing piece to a square which is unoccupied on the other side of such boat. This move may be on a straight line or on a diagonal line and the piece and boat may continue to move by jumping movement as long as there are alternant squares which are occupied and unoccupied to allow for such movement. Movement of a boat 25 containing a bishop 23 is on the diagonal as indicated by the dotted line and arrow. The boat 25 containing bishop 23 on square 5-V could move to square 10-X, provided that the intervening path is unoccupied. A boat 25 containing one of the knights 26 would move similarly in accordance with the moves permitted to the knight. The movement of large boat 26 is in accordance with the rules for movement of any or all of the pieces contained in that boat. The initial move of the boat may be made from either of the two squares which it occupies, i.e., 4-VII and 4-VIII. The move can be from either of these squares in accordance with the moves of the occupying pieces. The maximum utilization of large boat 26 in the game requires that is be occupied by one of each kind of playing piece, i.e., pawn, bishop, and knight. When occupied by all three types of playing pieces, boat 26 may move forward, backward or laterally according to the simple unobstructed moves of the knight or bishop or may move by jumping over the adjacent pieces to unoccupied squares on the other side of such piece in accordance with the moves of the pawn.

Up to this point, the moves of the pieces have been described in situations where opposing pieces are not encountered. It is therefore necessary to consider the rules of the game as applied to the capture of opposing pieces. When moving in the land area (black and white squares) the bishop 23 and the knight 24 capture pieces of opposite color by movement onto the square occupied by such piece. Moves which involve capture of an opposing piece are not compulsory as at checkers. Capture of an opposing piece by one of the pawns 22 is by a jumping move, as at the game of checkers, although the pieces may make the jumping moves in either a straight line forward or laterally or diagonally. When a piece is captured by a pawn jumping over it or by movement of a knight or bishop onto the square where such piece is located, such opposing piece is removed from the board.

In the sea area (blue and white squares) enlcosed by boundary 13, offensive action occurs only between boats 25 and 26 of opposing color when moving according to the moves of the pieces located in such boat. A boat moving according to moves of a bishop or a knight may capture a boat of opposite color by occupying the square on which such boat is located. A boat containing a pawn and moving according to the moves of a pawn may capture a boat of opposing color (containing a piece of the opposing color) by jumping over that boat to an unoccupied square on the other side. Pieces located in boats in the sea area (blue and white squares) may not be attacked by pieces moving from the land area (black and white squares) with one exception. If a pawn enters an empty boat 25 or 26 from the land area by jumping over a boat containing a piece of the opposite color, the piece so jumped and the boat containing it are considered captured and removed from the board. Pieces in the various boats moving in the sea area (blue and white area) may move to land in accordance with the movement of those pieces. Pieces being carried in the boats may therfore make attacking moves against opposing pieces on the adjacent land but may not be attacked from land with the exception noted above for a pawn entering an empty boat.

The objective of the game is to enter the opposing side of the board and occupy the target area enclosed by boundary line 19 or boundary line 16, respectively. Attempts to reach the target area may be by way of the land areas (black and white areas) on either side of the sea area (blue and white areas) or may be across the sea carried on the boats 25 and 26. It should be noted that in attacking the opponent's target area, the attacking pieces may capture pieces located inside the target area by the normal moves made by the attacking pieces. Once an attacking piece is positioned inside the target area, it is immune from capture by the opponent's pieces. Such a piece may take offensive action and capture opponent's pieces outside the target area, but in such case, the piece moving out of the target area would lose its immunity from capture. The game ends when one side has two of its pieces of any category, occupying the target area on the other side of the b Chinese checkers, and chess with additional strategic concepts introduced by the boats which carry pieces across the sea area (blue and white squares).

The game, as described, uses black and white squares for the land areas around the periphery of the board and blue and white squares for the sea area in the central portion of the board. Other colors could obviously be used for distinguishing these separate areas so long as the sea area is distinguished in color from the surrounding land area. The individual pieces may be black for one side and white for the other or any other suitable colors pairs, i.e., black and red, red and white, etc. The boats generally are of a shape fitting closely the shape of the pieces which they carry. The pieces are shown as having square bases, but could have round bases or bases of other shapes if desired, provided if the boats were made to accomodate. The pieces may be manufactured of wood, metal, plastic, paper mache, plaster, or any other suitable material of construction. The board is shown as one having fourteen rows and fourteen columns of squares of alternating color. The sea area is six squares in one direction by eight squares in the other direction with projecting areas for the initial positioning of the large boats. These areas could obviously be changed and the board made larger or smaller without varying the basic concept of the game. It should be obvious therefore to those skilled in the art that this invention does not have to be constructed precisely as described above and it should be understood that, within the scope of the appended claims, the invention may be practiced otherwise than as specifically described.

I claim:

1. A chess-like board game for two players comprising:

a checkered board with rows and columns of bilaterally colored dark and light squares, said board having a central area wherein the dark squares are of a different color from the color of the dark squares of the surrounding area designating a sea, a plurality of chess-like pieces for each player for movement on said board, all the said chess-like pieces having bases of substantially the same size, a plurality of boat pieces for each player for movement only in the sea of said board and incapable of indepentent movement, said boat pieces being initially positioned at the boundary of said sea area, said boat pieces being bowl shaped with a single central recess in the top surface thereof, said recess being of a shape capable of receiving the bases of said chess-like pieces, and being constructed to receive and support at least one of said chess-like pieces, at least one of said boat pieces sized larger than one of said colored squares and adapted to be placed over a plurality of said squares simultaneously, the single central recess in said at least one boat piece being of a size corresponding to the size of the bases of a plurality of said chess-like pieces placed side by side, such that said at least one boat piece is capable of supporting a plurality of side by side said chess-like pieces within said single recess in an upright manner, said chess-like pieces including a plurality of different shaped pieces, each different shaped chess-like piece having a different predetermined mode of movement and being moveable only in said surrounding area and into said boat pieces, said boat pieces being moveable only when supporting one of said chess-like pieces and taking the mode of movement of the piece supported and thus providing the means for movement of said playing pieces across said sea area, said boat pieces supporting a plurality of said chess-like pieces taking the mode of movement of each different shaped piece supported thereon, and said board having marked areas on opposite sides thereof as target areas, the occupation of which by an opponent's pieces being the objective of the game.

2. A board game according to claim 1 in which said chess-like pieces include at least one piece having the movement of the chess knight and taking opponent's pieces by occupying the square on which said piece rests.

3. A board game according to claim 1 in which said chess-like pieces include at least one piece having the movement of the chess bishop, and taking opponent's pieces by occupying the square on which said piece rests.

4. A board game according to claim 1 in which said chess-like pieces include a plurality of pieces combining the moving characteristics of the chess pawn and the checker playing piece, and taking opponent's pieces either by occupying the square, or jumping over the square on which said piece rests,

5. A board game according to claim 1 in which said board comprises fourteen columns of fourteen rows of playing squares.

6. A board game according to claim 5 in which said target areas are in rows one and fourteen of the board.

7. A board game according to claim 5 in which the playing pieces for each side comprise two knights, two bishops, and twenty pawns.

8. A board game according to claim 7 in which said boat pieces include one boat piece adapted to support three chess-like playing pieces, and six boat pieces adapted to support a single, chess-like playing piece.

* * * * *